US010300524B2

(12) United States Patent
Roemheld et al.

(10) Patent No.: US 10,300,524 B2
(45) Date of Patent: May 28, 2019

(54) CASTING COMPONENT HAVING AT LEAST ONE POROUS METAL BODY FORMED BY A CASTING CORE

(71) Applicant: Daimler AG, Stuttgart (DE)

(72) Inventors: Tilmann Roemheld, Waiblingen (DE); Michael Wagenplast, Schwaigern (DE)

(73) Assignee: Daimler AG, Stuttgart (DE)

( * ) Notice: Subject to any disclaimer, the term of this patent is extended or adjusted under 35 U.S.C. 154(b) by 173 days.

(21) Appl. No.: 15/022,516

(22) PCT Filed: Sep. 3, 2014

(86) PCT No.: PCT/EP2014/002383
§ 371 (c)(1),
(2) Date: Mar. 16, 2016

(87) PCT Pub. No.: WO2015/039730
PCT Pub. Date: Mar. 26, 2015

(65) Prior Publication Data
US 2016/0228940 A1 Aug. 11, 2016

(30) Foreign Application Priority Data
Sep. 17, 2013 (DE) ..... 10 2013 015 395

(51) Int. Cl.
*B22D 19/00* (2006.01)
*B22C 9/06* (2006.01)
(Continued)

(52) U.S. Cl.
CPC ..... *B22C 9/06* (2013.01); *B22C 9/105* (2013.01); *B22C 9/108* (2013.01); *B22D 15/02* (2013.01);
(Continued)

(58) Field of Classification Search
None
See application file for complete search history.

(56) References Cited

U.S. PATENT DOCUMENTS 2,609,576 A * 9/1952 Roush ..... B22C 7/02 164/132
3,133,857 A 5/1964 Swezey
(Continued)

FOREIGN PATENT DOCUMENTS

DE 34 18 405 A1 11/1984
DE 196 17 457 A1 3/1997
(Continued)

OTHER PUBLICATIONS

Chinese Office Action issued in Chinese counterpart application No. 201480051008.9 dated Dec. 12, 2016, with partial English translation (Twelve (12) pages).
(Continued)

*Primary Examiner* — Adam Krupicka
(74) *Attorney, Agent, or Firm* — Crowell & Moring LLP

(57) ABSTRACT

A casting component, in particular for a combustion engine of a motor vehicle, having at least one cavity formed by a lost casting core, where a porous metal body molded in the cavity is formed by the casting core, is disclosed. Furthermore, the casting core for such a casting component is formed by casting a metal, in particular an aluminum alloy, together with a salt. Finally, a method for the production of such a casting component or of such a casting core is also disclosed.

6 Claims, 2 Drawing Sheets

(51) Int. Cl.

| | |
|---|---|
| ***B22C 9/10*** | (2006.01) |
| ***B22D 15/02*** | (2006.01) |
| ***B22D 19/14*** | (2006.01) |

(52) U.S. Cl.
CPC ..... *B22D 19/0072* (2013.01); *B22D 19/0081* (2013.01); *B22D 19/14* (2013.01)

(56) References Cited

U.S. PATENT DOCUMENTS

| | | | | |
|---|---|---|---|---|
| 3,138,856 | A * | 6/1964 | Kuchekhenrya ... | B01D 39/2051 164/110 |
| 3,138,857 | A * | 6/1964 | Kuchekhenrya ... | B01D 39/2051 164/101 |
| 3,177,574 | A | 4/1965 | Kuchek | |
| 3,236,706 | A | 2/1966 | Kuchek | |
| 6,478,073 | B1 | 11/2002 | Grebe et al. | |
| 7,073,558 | B1 | 7/2006 | Nakajima | |
| 2007/0296106 | A1 | 12/2007 | Munz et al. | |
| 2011/0174246 | A1 | 7/2011 | Graf et al. | |

FOREIGN PATENT DOCUMENTS

| | | | |
|---|---|---|---|
| DE | 101 15 230 | A1 | 11/2001 |
| DE | 101 29 046 | A1 | 1/2003 |
| DE | 600 24 666 | T2 | 8/2006 |
| DE | 10 2007 023 060 | A1 | 11/2008 |
| DE | 10 2009 015 984 | A1 | 10/2010 |
| DE | 10 2012 022 331 | A1 | 5/2013 |
| EP | 1 844 881 | A2 | 10/2007 |
| WO | WO 98/00251 | A1 | 1/1998 |
| WO | WO 2010/057810 | A1 | 5/2010 |

OTHER PUBLICATIONS

German Office Action issued in German counterpart application No. 10 2013 015 395.6 dated Oct. 25, 2016 (Four (4) pages).

German Office Action issued in German counterpart application No. 10 2013 015 395.6 dated Apr. 5, 2017 (Five (5) pages).

PCT/EP2014/002383, International Search Report (PCT/ISA/220 and PCT/ISA/210) dated Feb. 18, 2015, with partial English translation, enclosing Written Opinion of the International Searching Authority (PCT/ISA/237) (Fifteen (15) pages).

German-language Office Action issued in German counterpart application No. 10 2013 015 395.6 dated May 21, 2014 (Five (5) pages).

* cited by examiner

CASTING COMPONENT HAVING AT LEAST ONE POROUS METAL BODY FORMED BY A CASTING CORE

BACKGROUND AND SUMMARY OF THE INVENTION

The invention relates to a casting component, in particular for a combustion engine of a motor vehicle, as well as a casting core for such a casting component. Furthermore, the invention relates to a method for the production of such a casting component As well as a method for the production of a casting core for such a component.

A casting component in the form of a cylinder crankcase and a method for the production of such a casting component can be gleaned as known from DE 10 2007 023 060 A1, wherein the production of a water jacket of the cylinder crankcase, designed as a cavity, occurs using a plurality of lost casting cores. More precisely, these casting cores are respective salt cores which are attached to a so-called cylinder liner in a preceding method for the guiding of respective pistons. After the molding of the cylinder liner during the production of the casting component, in a subsequent method, the respective salt cores, which consist of a water-soluble salt, are correspondingly rinsed out. Due to the lost casting or salt cores, the open cavities of the water jacket for cooling the cylinder crankcase are consequently formed.

The object of the present invention is to create a casting component and a casting core as well as a method for the production of such a casting component or of such a casting core, by means of which an increased strength or stiffness of the casting component can be achieved in the respective cavity formed by the casting core.

This object is solved according to the invention by a casting component as well as a casting core. Furthermore, this object is solved by a method for the production of a casting component or of a casting core.

In order to create a component which has an improved strength or stiffness in the region of the respective cavity, according to the invention it is provided that a porous metal body molded in the cavity is formed by the casting core. For this purpose, a casting core is used which is cast from a metal or a metal alloy together with a salt, in particular a crystal salt, or the same is processed. In particular, aluminum or an aluminum alloy, for example based on AlSi7, is thereby suitable as a metal or metal alloy. As included in the scope of the invention, however, it must be considered that other metals or metal alloys can also be used.

The porous metal body is generated by the salt from the lost casting core being rinsed out, in particular after the casting process of the casting component. An aqueous salt is preferably used here such that the salt can be washed out by rinsing with water. Then, the respective pores of the sponge-like, porous metal body are formed by the salt crystals or salt grains which are dissolved out. Overall, a porous metal body therefore results, by means of which the cavity generated by the casting core is at least partially filled. Due to this filling of the cavity, a structural reinforcement of the casting component and therefore a higher stiffness or strength results in this region. As a result, a weight saving can hereby also be achieved in the respective casting components as, due to the stiffening or reinforcement by means of the porous metal body, the respective walls surrounding the cavity can be dimensioned to be correspondingly smaller or thinner.

In a further advantageous embodiment of the invention, the casting component has at least one rinsing opening of the cavity which is open outwards, via which the salt is able to be rinsed out of the casting core for the formation of the porous metal body. In other words, according to the invention it is provided to insert the casting core into a casting tool, preferably as a semi-finished product with the salt still received therein, and to form the corresponding cavity by at least partial recasting or casting on with the casting material of the casting component. The rinsing out of the corresponding salt then occurs, for example, substantially only afterwards. The rinsing opening can be designed in such a manner that it is accessible directly after removal of the casting component from the casting tool, and that the salt can therefore be washed out directly after the casting process. Alternatively, the casting core can be completely recast such that firstly a (milling) processing of the casting component for partial exposure of the casting core (and therefore for the creation of the rinsing opening) must take place before the salt of the casting core can be washed out.

As is included in the scope of the invention, however, it must be considered that the salt can also be dissolved out of the respective casting core at least partially, even before the casting process. This is conceivable, for example, if, as is described below, an outer layer of the casting core is to be roughened for improved connection to the casting material of the casting component or if individual partial regions of the casting core or of the porous metal body can no longer be rinsed in connection with the casting process.

A further advantageous embodiment of the invention provides that the cavity within which the porous metal body is arranged is formed to guide a medium, in particular a coolant for the combustion engine of a motor vehicle. Such porous metal bodies in particular have the property of, on the one hand, stabilizing the cavity very well, however, on the other hand, having a sufficient permeability, such that a medium can circulate, for example cooling water or similar for the combustion engine of a motor vehicle.

In a further embodiment of the invention, the porous metal body and the casting component have materials or alloys having either at least substantially the same properties or, however, having different properties, in particular different thermal expansion coefficients. If the two respective alloys have at least substantially the same properties or these are at least substantially identical, then this has the advantage that a particularly good integration of the porous metal body into the respective casting component results. In particular, hereby, for example, tensions or similar within the casting component can be prevented and a good connection between the metal body and the casting component can be ensured. On the other hand, it can be advantageous if the alloys of the casting component or of the metal body are different. In particular, if the two alloys have different thermal expansions, a particularly favorable interlocking of the metal bodies within the casting component cavity can, for example, hereby be achieved.

The advantages referred to above in connection with the casting component according to the invention apply in the same way to the casting core.

In a further embodiment of the invention, regions within the casting core are provided with different metal proportions or salt proportions. Due to a corresponding variation of the metal or salt content, a corresponding variation of the porosity, size of the respective pores or similar can be generated in order to hereby influence, for example, the stiffness and strength of the metal body and of the casting component.

The advantages described above in connection with the casting component according to the invention and the associated casting core apply in the same way to the method for the production of a casting component.

In an advantageous embodiment it is thereby provided in the invention that the outer layer of the casting core is treated before the molding into the casting material of the casting component. For example, a corresponding coating of the casting core can be provided in this case in which, for example, less salt or, however, also more salt is provided than in an average region. Potentially, a roughening or structuring of the outer skin or outer layer of the casting core can also occur in order to achieve an improved interlocking of the casting core or of the metal body within the casting material of the casting component. For example, it is therefore also conceivable to roughen the outer layer of the casting core in that the corresponding salt is dissolved out already in this region before the casting of the casting component.

The advantages referred to in connection with the casting component according to the invention or the associated casting core as well as the corresponding method for the production of a casting component apply in the same way to the method for the production of the lost casting core.

Further advantages, features and details of the invention result from the subsequent description of a preferred exemplary embodiment as well as by means of the drawings.

DETAILED DESCRIPTION OF THE DRAWINGS

Figure 1A:
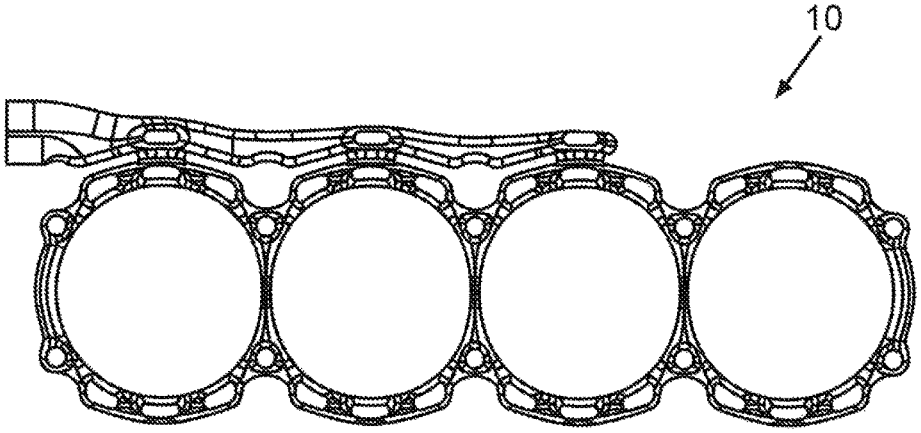
FIGS. 1*a*, 1*b* are a top view and a perspective sectional view onto a casting core for a casting component in the form of a crankcase of a combustion engine of a motor vehicle, by means of which a cavity in the form of a water jacket for respective cylinders of the combustion engine is able to be generated, and which is formed by casting a metal, in particular an aluminum alloy, together with a salt.
Figure 1B:
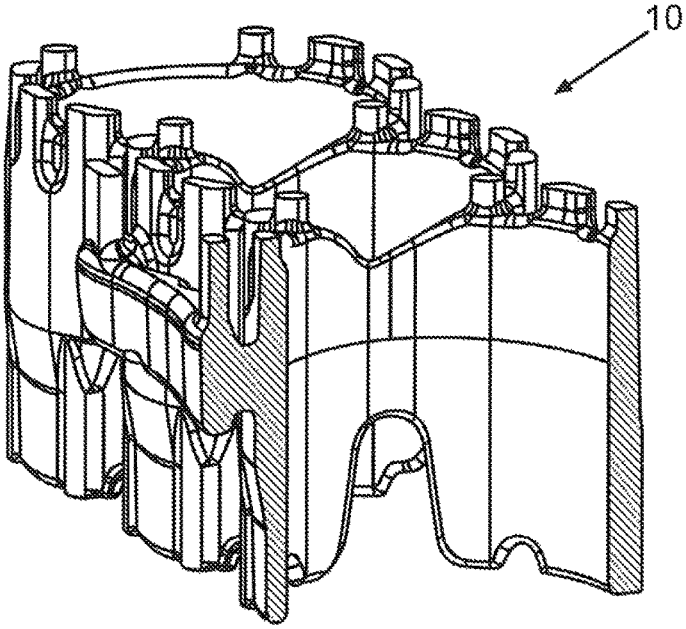
Figure 2A:
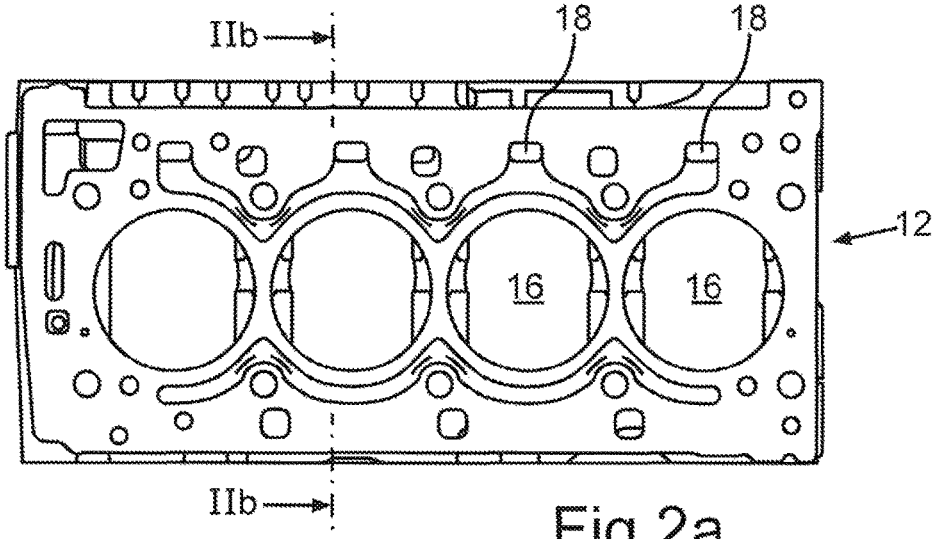
FIGS. 2*a*, 2*b* are a schematic top view and schematic sectional view along a sectional plane represented by the line IIb-IIb in FIG. 2*a* through the casting component in the form of the crankcase of the combustion engine for a motor vehicle, wherein it is recognizable that the cavity formed by the casting core in the form of the water jacket is filled by a porous metal body which has been formed by rinsing out the salt from the casting core.
Figure 2B:
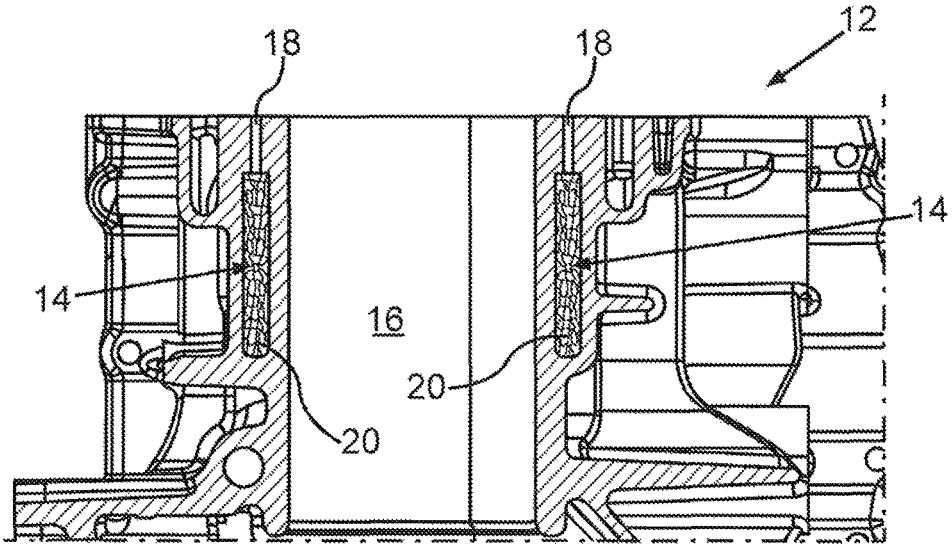

In FIGS. 1*a* and 1*b*, a casting core 10 is depicted in a schematic top view and perspective sectional view, by means of which, in a casting process for the production of a casting component 12 depicted in FIGS. 2*a* and 2*b* in the form of a cylinder crankcase for a combustion engine of a motor vehicle, a related cavity 14 is created which forms a water jacket for respective cylinders 16 of the combustion engine in a way which is described in more detail below.

Firstly, in a corresponding method, the lost casting core 10 is generated by casting a metal, in particular aluminum or an aluminum alloy, together with a salt. For this purpose, in a corresponding casting process, the metal melt is mixed with the salt and cast. Other production processes, however, are also conceivable.

For example, an aluminum alloy based on AlSi7 is suitable as an alloy. Of course, a plurality of other alloys, in particular aluminum-based alloys, are conceivable. Likewise, pure metals are also conceivable. In particular, water-soluble salts which can be removed from the casting core in a simple way, for example in a corresponding bath or by rinsing in a way which is described in more detail below, are suitable as a salt.

In a method for the production of the casting component 12, subsequent to the production of the casting core 10, the lost casting core 10 is then inserted into a corresponding casting tool for the formation of the water jacket or cavity 14 and is then molded at least partially into the casting material of the casting component 12. In principle, all conventional pure metals or alloys are conceivable as a casting material. In the present case, an aluminum-based alloy is concerned which is processed in a die casting process for the production of the casting component 12. A substantial advantage of the casting core 10 used here, in which the salt is still located inside the metal, therefore consists in this being able to be processed in a die casting method with correspondingly high casting pressures. It is, however, also conceivable to use the casting core 10 in another casting method, for example low pressure or sand casting methods.

In the present exemplary embodiment, the salt is rinsed out from the casting core 10 in connection with the casting process. For this purpose, the casting component 12 has at least one rinsing opening 18 facing outwards such that the casting core 10, which forms and fills the cavity 14, can be impinged correspondingly with a rinsing medium, water in the present case. In a corresponding rinsing process, within a water bath or by direct impingement with a water flow/water stream, the salt is rinsed out from the casting core 10 such that, overall, a porous metal body 20 is created which is able to be recognized in particular in FIG. 2*b*. It would also be theoretically conceivable, as specified, however, to use the metal body 20 which has already been freed at least partially of salt or rinsed in the casting process. In the present die casting method, however, the salt grains within the pores of the metal body 20 ensure that the casting core 10 does not collapse.

In the present case, this metal body 20 fills the corresponding cavity 14 completely, the cavity 14 forming the water jacket for the casting component 12 in the form of the cylinder crankcase. It would, however, also be conceivable that the metal body 20 only fills a part of the cavity 14. This would, for example, be conceivable, by a combined casting core 10 being created in which a part is formed from the combination described above of metal and salt and, for example, another part from a material which can be removed completely after the casting process, for example by rinsing or similar. This material can, for example, be salt.

Overall, it is therefore able to be recognized that the casting core 10 shown in FIGS. 1*a* and 1*b* represents a semi-finished product which is presently recast with a corresponding metal melt of the casting component 12 and then rinsed for the formation of the porous metal body 20.

The porous metal body 20 thereby results in the advantage that, in the region of the cavity 14, the strength and the stiffness of the casting component 12 is clearly increased. This benefits, for example, the static and dynamic properties of the casting component 12. Furthermore, regions of the casting component 12 adjacent to the cavity 14 are dimensioned to be smaller, as the metal body 20 contributes to the stiffening of the casting component 12.

The metal of the casting core 10 or of the porous metal body 20 and of the casting component 12 consists either of materials having at least substantially the same properties or, however, of materials having different properties, in particular different thermal expansion coefficients. If the materials of the metal body 20 and the casting component 12 are matched to one another or are identical, then, for example, a particularly favorable molding and a particularly favorable connection between the metal body 20 and the casting component 12 occurs. Additionally, even in the case of heat fluctuations, the thermal expansion and other material properties are substantially identical such that, for example, no tensions or similar can result within the casting component 12. On the other hand, if different alloys or pure metals are used for the metal body 20 and the casting component 12, it can be advantageous to obtain correspondingly different material properties, such as, for example, different thermal expansions. This is, for example, then advantageous if the metal body 20 is to interlock or bond in the casting component 12 in the case of a thermal expansion.

Furthermore, regions with different metal proportions or salt proportions can be provided within the casting core 10. For example, the porosity of the metal body 20 can hereby be adjusted in order to vary the stiffness or strength of the casting component 12 overall in the region of the cavity 14.

Furthermore, a rinsing out of the salt from the casting core 10 can occur at least partially before the insertion into the casting tool for the production of the casting component 12. For example, it would be conceivable to roughen the outer layer of the casting core 10 before the molding into the casting material of the casting component in that this is already freed of the salt. Therefore, a particularly good bond between the casting material of the casting component 12 and the metal of the casting core 10 of the metal body 20 results. Furthermore, it would be conceivable to provide the casting ore 10 with a skin or an outer skin which is free of salt, for example. Likewise, a particularly favorable connection between the casting core 10 and the casting component 12 is hereby achieved.

If the metal body 20, as in the present case, is arranged within a cavity 14 forming a water jacket, then a variation of the porosity thereof, for example by adjustment of the metal or salt content of the casting core 10, can influence the flow of the coolant through the water jacket/cavity 14 in a targeted manner.

Overall, it is therefore able to be recognized that, in the present case, a casting component 12 and a casting core 10 as well as an associated method are created, by means of which firstly corresponding cavities 14 can be formed within the casting component 12, wherein correspondingly improved stiffness or strength values result within the casting component 12. Furthermore, the use of the porous metal body 20 is suitable, in particular in casting components 12 which must be flowed through by a medium, in particular a coolant. Here, the metal body 20 does not represent a notable obstacle for the corresponding coolant. The water jacket/cavity 14 can thereby also only be partially provided with one or more metal bodies 20, for example in particular in respective bar regions of the crank shaft casing.

The invention claimed is:

1. A casting component of a combustion engine of a motor vehicle, comprising:

a casting material; and a lost casting core including a metal and a salt disposed within the casting material, wherein the salt is dissolvable out from the lost casting core to form a porous metal body from the metal in the casting component.

2. The casting component according to claim 1, wherein the casting component has a rinsing opening facing outwards via which the salt is dissolvable out from the lost casting core.

3. A casting component of a combustion engine of a motor vehicle, comprising:

a cavity formed by a lost casting core;

wherein the lost casting core is a molded casting core including a metal and a salt and wherein the molded casting core forms a porous metal body in the cavity;

wherein the porous metal body and the casting component are formed from materials having same properties.

4. The casting component according to claim 1, wherein the porous metal body and the casting component are formed from materials having different thermal expansion coefficients.

5. A method for producing a casting component of a combustion engine of a motor vehicle, comprising the steps of:

inserting a lost casting core into a casting tool;

molding the lost casting core at least partially into a casting material of the casting component;

wherein the lost casting core is a molded casting core including a metal and a salt; and dissolving the salt out from the molded casting core to form a porous metal body in the casting component.

6. The method according to claim 5, wherein an outer layer of the lost casting core is treated before the molding into the casting material of the casting component.

* * * * *